US010734180B2

(12) United States Patent
Tirén et al.

(10) Patent No.: US 10,734,180 B2
(45) Date of Patent: Aug. 4, 2020

(54) FIELD EMISSION CATHODE STRUCTURE FOR A FIELD EMISSION ARRANGEMENT

(71) Applicants: Lightlab Sweden AB, Uppsala (SE); Nanyang Technological University, Singapore (SG)

(72) Inventors: Jonas Tirén, Uppsala (SE); Patrik Hollman, Uppsala (SE); Hilmi Volkan Demir, Singapore (SG); Vijay Kumar Sharma, Singapore (SG); Swee Tiam Tan, Singapore (SG)

(73) Assignees: Lightlab Sweden AB, Uppsala (SE); Nanyang Technological University, Singapore (SG)

( * ) Notice: Subject to any disclaimer, the term of this patent is extended or adjusted under 35 U.S.C. 154(b) by 0 days.

(21) Appl. No.: 16/625,931

(22) PCT Filed: Jun. 20, 2018

(86) PCT No.: PCT/SE2018/050666
§ 371 (c)(1),
(2) Date: Dec. 23, 2019

(87) PCT Pub. No.: WO2019/009785
PCT Pub. Date: Jan. 10, 2019

(65) Prior Publication Data

US 2020/0161071 A1 May 21, 2020

(30) Foreign Application Priority Data

Jul. 5, 2017 (SE) ..... 1750878

(51) Int. Cl.

| | |
|---|---|
| ***H01J 1/304*** | (2006.01) |
| ***H01J 29/94*** | (2006.01) |
| ***H01J 1/48*** | (2006.01) |

(52) U.S. Cl.
CPC ..... *H01J 1/304* (2013.01); *H01J 1/48* (2013.01); *H01J 29/94* (2013.01); *H01J 2201/30469* (2013.01)

(58) Field of Classification Search
CPC ... H01J 1/304; H01J 29/94; H01J 2201/30469
(Continued)

(56) References Cited

U.S. PATENT DOCUMENTS

| | | | | |
|---|---|---|---|---|
| 6,545,396 | B1 | 4/2003 | Ohki et al. | |
| 10,529,525 | B2 * | 1/2020 | Lee | H01J 35/065 |

(Continued)

FOREIGN PATENT DOCUMENTS

| | | | |
|---|---|---|---|
| EP | 2375435 | A1 | 10/2011 |
| TW | 200737282 | A | 10/2007 |
| WO | 2016096717 | A1 | 6/2016 |

OTHER PUBLICATIONS

International Search Report and Written Opinion for International Application No. PCT/SE2018/050666 dated Aug. 9, 2018, 13 pages.

*Primary Examiner* — Christopher M Raabe
(74) *Attorney, Agent, or Firm* — RMCK Law Group, PLC

(57) ABSTRACT

The present disclosure generally relates to field emission cathode structure for a field emission arrangement, specifically adapted for enhance reliability and prolong the lifetime of the field emission arrangement by arranging a getter element underneath a gas permeable portion of the field emission cathode structure. The present disclosure also relates to a field emission lighting arrangement comprising such a field emission cathode structure and to a field emission lighting system.

20 Claims, 3 Drawing Sheets

(58) Field of Classification Search
USPC ..... 313/496
See application file for complete search history.

(56) References Cited

U.S. PATENT DOCUMENTS

| | | | | |
|---|---|---|---|---|
| 2001/0034174 | A1* | 10/2001 | Moore | B82Y 10/00 445/24 |
| 2003/0160561 | A1 | 8/2003 | Park et al. | |
| 2006/0091782 | A1* | 5/2006 | Liu | H01J 63/06 313/496 |
| 2007/0146862 | A1* | 6/2007 | Moore | B82Y 20/00 359/245 |
| 2007/0188075 | A1 | 8/2007 | Kimiya et al. | |
| 2007/0222356 | A1 | 9/2007 | Qian et al. | |
| 2008/0007154 | A1* | 1/2008 | Wei | B82Y 10/00 313/497 |
| 2019/0287786 | A1* | 9/2019 | Tiren | H01J 19/24 |

* cited by examiner

FIELD EMISSION CATHODE STRUCTURE FOR A FIELD EMISSION ARRANGEMENT

CROSS-REFERENCE TO RELATED APPLICATIONS

This application is a 371 U.S. National Stage of International Application No. PCT/SE2018/050666, filed Jun. 20, 2018, which claims priority to Swedish Patent Application No. 1750878-9, filed Jul. 5, 2017. The disclosures of each of the above applications are incorporated herein by reference in their entirety.

TECHNICAL FIELD

The present disclosure generally relates to field emission cathode structure for a field emission arrangement, specifically adapted for enhance reliability and prolong the lifetime of the field emission arrangement by arranging a getter element underneath a gas permeable portion of the field emission cathode structure. The present disclosure also relates to a field emission lighting arrangement comprising such a field emission cathode structure and to a field emission lighting system.

BACKGROUND

The technology used in modern energy saving lighting devices uses mercury as one of the active components. As mercury harms the environment, extensive research is done to overcome the complicated technical difficulties associated with energy saving, mercury-free lighting.

An approach used for solving this problem is to use field emission light source technology. Field emission is a phenomenon which occurs when a very high electric field is applied to the surface of a conducting material. This field will give electrons enough energy such that the electrons are emitted (into vacuum) from the material.

In prior art field emission light sources, a cathode is arranged in an evacuated chamber, typically being a bulb with glass walls, wherein the chamber on its inside is coated with an electrically conductive anode layer. Furthermore, a light emitting layer is deposited on the anode. When a high enough potential difference is applied between the cathode and the anode thereby creating high enough electrical field strength, electrons are emitted from the cathode and accelerated towards the anode. As the electrons strike the light emitting layer, typically comprising a light powder such as a phosphor material, the light powder will emit photons. This process is referred to as cathodoluminescence.

Recent advances in research and development within the area of field emission light sources have made it possible to miniaturize the field emission light source such that it may be manufactured as an in comparison small lighting chip rather than the prior-art bulb shaped field emission light source. An example of a chip based field emission light source is disclosed in W02016096717, by the same applicant and incorporated in its entirety by reference.

In W02016096717, the field emission light source is disclosed to be possible to be manufactured in large volumes at low cost using the concept of wafer level manufacturing, i.e. using a similar approach as used by IC's and MEMS. In accordance to W02016096717, a plurality of field emission light sources each comprises a field emission cathode comprising a plurality of nanostructures formed, a spacer element and a cathodoluminescent anode, all arranged on the same wafer substrate.

Specifically, in accordance to W02016096717 a large number of field emission light sources are manufactured at the same time on a large glass substrate also referred to herein as a wafer. A plurality of spacer element is subsequently placed so that each spacer element encompasses each field emission cathode with a certain minimum distance between the spacer element wall and the cathode. Lastly a plurality of small glass pieces (usually circular), containing the anodes, are sealed on to the spacers so that for each individual field emission light source a cavity is formed. This sealing is done under vacuum. Alternatively the plurality of small glass pieces is replaced by another large glass substrate (of a similar size as the first).

In addition, a getter element is placed inside each cavity in order to maintain the vacuum level for prolonged periods of time. It should be noted that the position of the anode and the cathode in this short description is entirely interchangeable. The getter element is essential in order to obtain field emission light sources that will operate during any prolonged periods of time.

During operation of the field emission light source, the cathode will emit an electron current when a high enough electrical field is applied. The electrons travel through the evacuated space between the cathode and the anode. If too much rest gas molecules are present the electrons may strike these molecules and some of these may be ionized. If these events are too many an arcing phenomena will occur. Such arcing may be harmful for the field emission light source.

Even if this ionization breakdown does not occur the above events create less than one secondary event, whereby the rest gas molecules may be positively charged. If this happens they will be attracted to the cathode. If enough such molecules are covering the cathode they will start limiting the cathodes ability to emit electrons, the rest gas molecules quench the emission by introducing an additional barrier.

Rest gas molecules are always present to some extent. Furthermore, there will be additions over time of such molecules through surface desorption, outgassing from the materials forming the cavity, permeation through and diffusion out of said materials. When the field emission light source is operated, there is inevitably a self-heating of the field emission light source, especially on the anode. This heat will accelerate these processes adding rest gas molecules to the field emission light source cavity.

From experience of large scale field emission light sources, a pressure of less than $1\times10^{-4}$ Torr should be present to avoid such phenomena. The initial pressure should be in the order of $1\times10^{-6}$ Torr to allow for a sufficient life time of the field emission light source. It should be noted that it is very difficult to accurately assess the actual pressure in the very small cavities formed in the chip scale field emission light sources.

A getter element is in principle a special alloy that will react with various rest gas molecules such as $H_2$, $O_2$, $N_2$, hydrocarbons. Specifically, a high performance getter element named HPTF, from SAES Getters S.p.A. of Italy, is supplied in the form of small thin strips, thus suitable for the use in such a small cavity.

The getter element must be placed inside the cavity. At the same time, the field emission light source is operating at typically 5-10 kV and the corresponding electrical field is high. The placement of the getter element must consider these electrical potentials so that no parasitic current—or even arcing with the aid of the getter element—occurs. Typically a strip is placed close to the spacer element but as far away from the connecting strips to the anode and the cathode, respectively. In addition, the getter element must also be mechanically attached so it will not move around inside the cavity. This process is add complexity and is costly; adding to the size and complexity of the resulting field emission light source. Accordingly, there is a desire to provide improvements in the relation to positioning of the getter element within a field emission light source to at least partly handle the presented prior-art problems.

SUMMARY

According to an aspect of the present disclosure, the above is at least partly alleviated by a field emission cathode structure for a field emission arrangement, comprising a substrate having a first and a second side, a getter element arranged on top of the first side of the substrate and covering a portion of the first side of the substrate, an at least partly permeable structure arranged on top of at least a portion of the getter element, and an electron emission source arranged to cover a portion of the at least partly permeable structure.

Thus, by means of the present disclosure it is made possible to position the getter element underneath an at least partly permeable structure comprised with the field emission cathode, whereby the rest gas molecules as discussed above are allowed to "pass through" the at least partly permeable structure comprised with the field emission cathode. Accordingly, rather than having to position the getter element "somewhere within the cavity", the getter element is in accordance to the present disclosure "stacked" e.g. directly below the cathode. Thus, the getter element may in one embodiment of the present disclosure be seen as sandwiched between the substrate and the at least partly permeable structure, where e.g. the at least partly permeable structure essentially encapsulates the getter element.

In accordance to the present disclosure, the least partly permeable structure is provided with an electron emission source arranged to cover a portion of the at least partly permeable structure. The electron emission source may in one embodiment of the present disclosure comprise a plurality of nanostructures. The nanostructures may in turn preferably comprise at least one of ZnO nanostructures and carbon nanotubes. The plurality of ZnO nanostructures is adapted to have a length of at least 1 um. In another embodiment the nanostructures may advantageously have a length in the range of 3-50 μm and a diameter in the range of 5-300 nm.

Preferably, the at least partly permeable structure of the cathode may comprise protruding elements to achieve a first electrical field amplifying effect. The same first amplifying effect may also be achieved by using a wire to form part of the at least partly permeable structure. The above discussed nanostructures are typically arranged to "cover" the protruding elements or the wire.

In accordance to the present disclosure, the least partly permeable structure may comprise a plurality of wires arranged essentially in parallel and/or in a mesh or net formation, thereby further enhancing the permeable effects of the least partly permeable structure. The above mentioned wire mesh may in accordance to one embodiment of the present disclosure have a first field amplifying effect both from the wire shape and from the waved shape lengthwise the wire as is common from for example a woven net.

An advantage following the use of the wire mesh is that the getter element may be mechanically "kept in place" below the least partly permeable structure, thus not allowed to make e.g. electrical contact with other relevant components comprised with the field emission arrangement. In addition, it may preferably and easily be electrically connected to the cathode material. This means that any positively ionized rest gas molecule will be attracted (by Coulomb attraction) not only to the cathode (where it may cause problems with emission quenching) but to the getter element where it will be absorbed. Preferably, the getter element and the electron emission source are electrically connected to each other.

In accordance to the present disclosure, field emission occurs when a large enough electrical field is applied to a material. For a flat surface, typical field strengths are in the order of a few Giga Volt/meter. In practical applications these voltages are far too high and therefore several steps are taken to enhance the local field strength to achieve local field emission. In a plane parallel structure as in a miniature Field Emission Light Source (chip) the applied macroscopic electrical field is given by:

$$E(d) = \frac{V}{d}$$

where V is the applied voltage and d is the distance between the anode and the cathode.

Using a typical example of d=2 mm the resulting field strengths at V=1000 V becomes 0.5 MV/m, i.e. 3-4 orders of magnitude below what is needed.

The first step of the field amplification can be provided by the wire structure in the mesh/net. This amplification may be estimated by using computer based computations using Maxwell's equations. Such amplification will be in the order of 1.5 times-5 times, typically 2 times using practical dimensions and placement of the mesh. The amplification is determined by the radius of the mesh wire, its distance to the underlying ground plane and the distance between the wires. The distance between the wires and the wire radius are the most important parameters. (The distance to the ground plane is theoretically important but is essentially given by the device design).

These geometrical design parameters will also give a total cathode area and the total area of the mesh openings. It is the nanostructures which provide extremely sharp tips that will enhance the field further. The emission for a single emitter follows the Fowler-Nordheim equation:

$$I = A_r a \frac{\beta^2 E^2}{\phi} e^{-\frac{b\phi^{3/2}}{\beta E}},$$

where $A_r$ is the effective emitter area, a is the first Fowler-Nordheim constant;

$$a = 1.54 \times 10^{-6} \left[\frac{AeV}{V^2}\right],$$

b is the second Fowler-Nordheim constant:

$$b = 6.83 \times 10^{9} \left[\frac{V}{meV^{\frac{3}{2}}}\right],$$

Ø is the work function in eV (5.1-5.3 eV for ZnO) and β is a dimensionless amplification factor. As long as the emitters are operating with field emission, a plot of $$\ln\left(\frac{I}{V^2}\right) \text{ vs. } \frac{1}{V}$$

will give a straight line, and β can be found from the slope.

The amplification factor β will depend on the morphology of the emitter. In a first order approximation β will be depending on the height h and the sharpness r of the nanostructure Using the above discussed wire mesh structure; the electrons will be emitted from the nanostructures on the upper portion of the wire, where the first amplification of the electrical field is the largest. By calculating the electrical field strength along the wire circumference it is possible to estimate which portion that is involved. The emission current will drop sharply as moving from the top center part of the wire along the wire surface, since the electrical field strengths decreases along the same circumference.

The electrons will be emitted in a diverging pattern and will thus cover a certain area of the anode. From such trajectory simulations it is then possible to establish the preferred geometry of the metal mesh. In doing so, it is important that the entire anode area is covered with electrons as uniform as possible. The intensity of light emitting material will degrade as a function of the received total charge. This means that if one part of the anode receives significantly higher amounts of electrons than another part, it will lose intensity faster and the effective life time of the device will be shortened. If some part of the anode does not receive as many electrons as other parts it will effectively not emit any photons. To maintain the optical power output, other parts of the anode must then be loaded by a higher current and the device life time is again reduced for the same reason.

The above may impose one set of design parameters on the mesh, such as wire diameter and wire spacing. On the other hand, it is desirable to make it an easy as possible for any rest gas molecule to reach the getter elements, i.e. the mesh openings should be as large as possible.

Thus, the present disclosure will solve or reduce the above topics with placement, mechanical stability, cathode quenching and at the same time reduce requirements on the nanostructures as the wire mesh will enhance the electrical field. The physical design of the mesh may be optimized to give a uniform emission impact on the anode while maximizing the open areas for rest gas molecules to be absorbed by the getter element.

In accordance to the present disclosure, the getter element may for example formed by arranging (or depositing) a layer of a getter material onto the portion of the substrate. In a possible embodiment the getter material is non-evaporable getter material, for example comprising a getter material comprises at least one of tantalum (Ta), zirconium (Zr), titanium (Ti), hafnium (Hf), and/or their alloys. Possibly, a thickness of the layer of getter material is about 20-500 μm, preferably 50-200 μm.

Furthermore, in a preferred embodiment the substrate is planar, preferably provided as a wafer. In line with the above discussion, using a wafer substrate may allow for mass production of the field emission cathode structures for use in e.g. relation to a field emission light source. The wafer may possibly be a silicon wafer.

In accordance to the present disclosure, the field emission cathode structure preferably forms part as a component of a field emission lighting arrangement further comprising an evacuated chamber, an anode structure arranged within the evacuated chamber, and a light emission member provided with an electron-excitable light emitting material, the light emission member arranged within the evacuated chamber, wherein the getter element is adapted to be activated prior to operation of the field emission lighting arrangement. The field emission cathode structure is according to this embodiment arranged within the evacuated chamber.

The electron energy used for consumer applications should be less than 10 kV and preferably less than 9 kV or soft X-rays generated by Bremsstrahlung will be able to escape the lighting arrangement (it is otherwise absorbed by the anode glass). However these levels are to some extent depending on glass thickness, thus higher voltages can be allowed if a thicker glass is used.

On the other hand the electron energy must be high enough to penetrate the conductive and reflecting layer as discussed above. A preferred range for consumer applications is thus 7-9 kV and 7-15 kV for industrial applications (where some soft X-rays can be accepted). Furthermore, in line with the above discussion the evacuated chamber needs to be under partial vacuum so that the electrons emitted from the cathode may transit to the anode with only a small number of collisions with gas molecules. Frequently the evacuated space may be evacuated to a pressure of less than $1\times10^{-4}$ Torr.

In line with the present disclosure, a plurality of field emission lighting arrangement may be arranged together, forming a field emission lighting system.

Further features of, and advantages with, the present disclosure will become apparent when studying the appended claims and the following description. The skilled addressee realize that different features of the present disclosure may be combined to create embodiments other than those described in the following, without departing from the scope of the present disclosure.

BRIEF DESCRIPTION OF THE DRAWINGS

The various aspects of the present disclosure, including its particular features and advantages, will be readily understood from the following detailed description and the accompanying drawings, in which.

DETAILED DESCRIPTION

Figure 1:
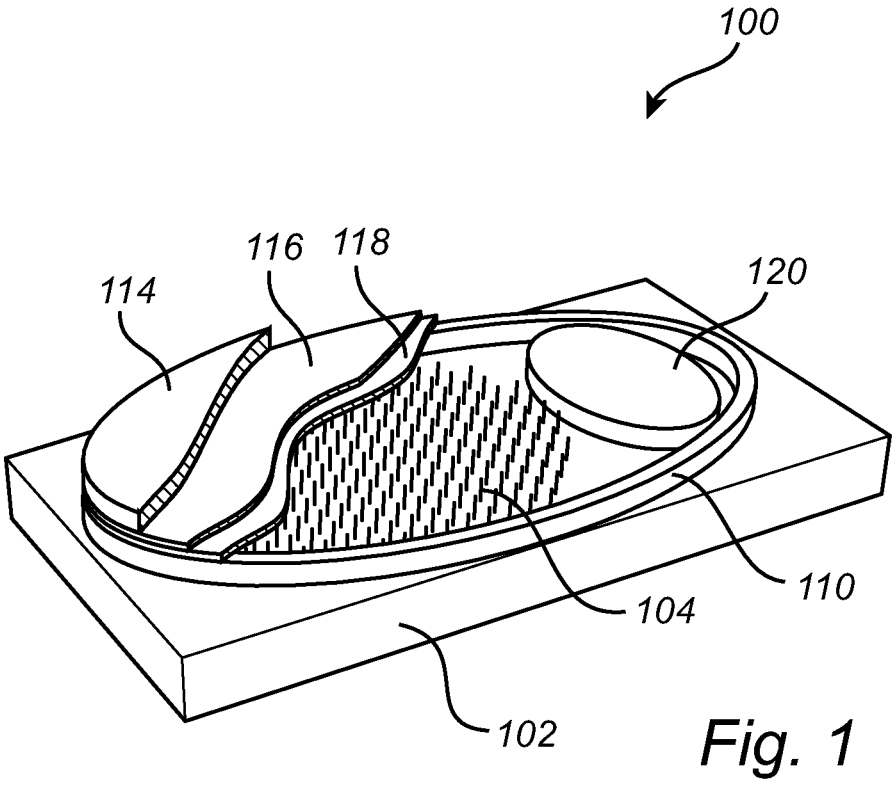
FIG. 1 illustrates a perspective view of a chip based field emission light source according to prior-art, FIGS. 2A-2C conceptually illustrates a first exemplary embodiment of the present disclosure.

The present disclosure will now be described more fully hereinafter with reference to the accompanying drawings, in which currently preferred embodiments of the present disclosure are shown. This present disclosure may, however, be embodied in many different forms and should not be construed as limited to the embodiments set forth herein; rather, these embodiments are provided for thoroughness and completeness, and fully convey the scope of the present disclosure to the skilled addressee. Like reference characters refer to like elements throughout.

Referring now to the drawings and to FIG. 1 in particular, there is provided a perspective view of a field emission light source 100 according to prior-art, exemplified to have an essentially elliptical shape and arranged to emit light e.g. within the visible and/or UV light spectrum. Other shapes are feasible, such as being essentially rectangular; however an elliptical (or circular or similarly rounded) shape has advantages, for example in terms of avoiding electrical phenomena as arcing and parasitic currents. Such phenomena may otherwise become an issue when high electrical fields are applied and corners or edges are present. The field emission light source 100 comprises a wafer 102 provided with a plurality of ZnO nanorods 104 having a length of at least 1 um, the wafer 102 and plurality of ZnO nanorods 104 together forming a field emission cathode. It may also, as an alternative, be possible to substitute the ZnO nanorods 104 for carbon nanotubes (CNT, not shown). The field emission light source 100 further comprises an anode structure arranged in close vicinity of the field emission cathode. In any of the figures only one singular device is shown but the wafer may contain large numbers of such devices.

The distance between the field emission cathode and the anode structure in the current embodiment is achieved by arranging a spacer structure 110 between the field emission cathode and the anode structure, where a distance between the field emission cathode and the anode structure preferably is between 100 um to 5000 um. A cavity formed between the field emission cathode and the anode structure is evacuated, thereby forming a vacuum between the field emission cathode and the anode structure.

The anode structure comprises a transparent substrate, such as a planar glass structure 114. Other transparent materials are equally possible and within the scope of the invention. Examples of such materials are sodalime like glass, borosilicate glass, quartz and sapphire. The transparent structure 114 is in turn provided with a phosphor layer 116, converting electron energy into photons. The exact properties of the phosphor material will determine the photon wavelengths. The phosphor layer 116 may be deposited by a number of commercially available standard methods, e.g. spraying, screen-printing and the like. Other methods are equally possible ad within the scope of the present disclosure. On top of the phosphor is a conductive layer 118, forming the anode electrical contact. Suitable materials for this layer are for example Aluminum and Silver.

The thickness of this layer is selected so that a) it is thin enough for electrons of the selected energy to pass through the layer without any significant loss of energy and b) at the same time thick enough to give an as high reflectance as possible, thus reflecting photons generated in the phosphor layer directed towards the conductive layer 118 back and through the glass 114 (unless reflection occur.) The conductive layer 118 may be deposited by a number of methods, sputtering and evaporation serving as two examples.

In some embodiments where the field emission light source 100 is specifically adapted for emitting visible light, it may also be possible to use a transparent conductive oxide (TCO) layer as the conductive layer, such as an indium tin oxide (ITO) layer. The thickness of such an ITO layer is selected to allow maximum transparency with a low enough electrical resistance. A typical transparency is selected to be above 90%. Using an ITO layer is generally not suitable for UV applications.

The phosphor material 116 is capable of conversion of electron energy to photons. The phosphor material 116 may, as mentioned above, be adapted to convert electrons to UV or visible light. Examples of phosphor materials suitable for UV light generation comprise for example LuPO3:Pr3+, Lu2Si2O7:Pr3+, LaPO4:Pr3+, YBO3:Pr3+ and YPO4:Bi3+. Other similar materials may be equally feasible.

The field emission light source 100 further comprises a getter element 120. The getter element 120 is arranged adjacently to the nanostructures 114 at a bottom surface of the cavity formed by the spacer structure 110 surrounding the nanostructures 114 and the getter element 120. The getter element 120 is a deposit of reactive material that is provided for completing and maintaining the vacuum within the cavity 112, as has been discussed above.

In FIG. 1, the getter element 120 is exemplified as a thin sheet being placed along the side of the spacer element. It may also be deposited as a suitable alloy. To avoid short electrical breakdown and parasitic surface currents the anode and cathode contacting elements (not shown) are placed as well away from the getter element 120 and each other (not explicitly shown). The getter element 120 further is mechanically attached, e.g. to the wafer 102. In FIG. 1 the getter element 120 is shown as being directly arranged at a top surface of the wafer 102, however it has been previously known to also position the getter element 120 in a specially designed cavity arranged at the surface of the wafer 102. Even though the introduction of a cavity may be useful from an attachment perspective, such a solution adds to the cost, complexity and size of the to the field emission light source 100. A typical getter may be HPTF foils, by SAES Getters of Italy.

Figure 2B:
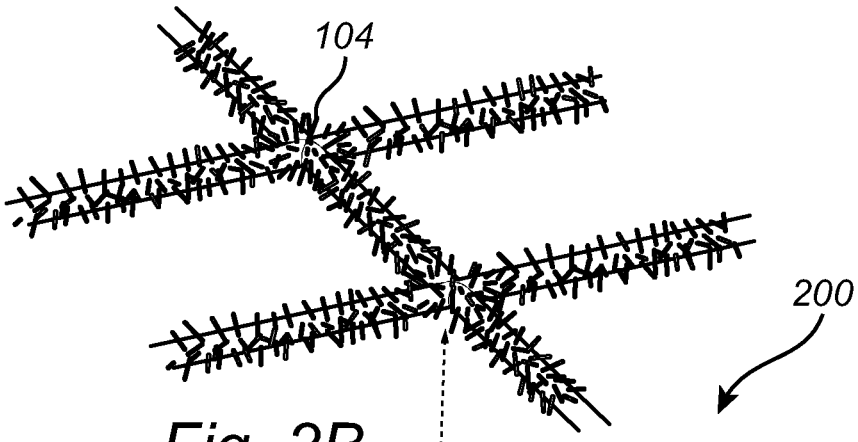
Figure 2A:
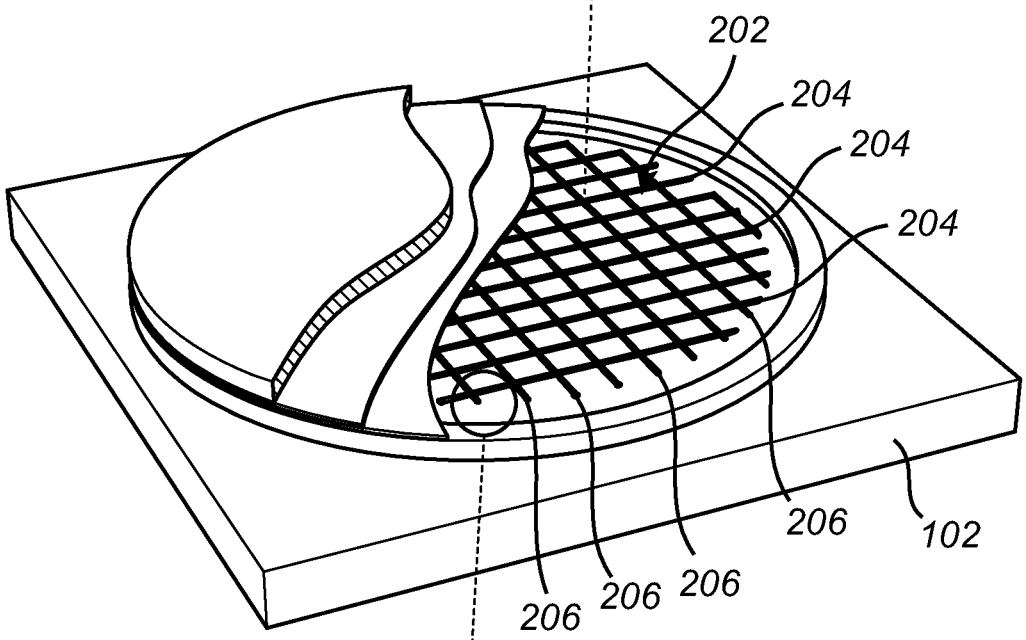
Figure 2C:
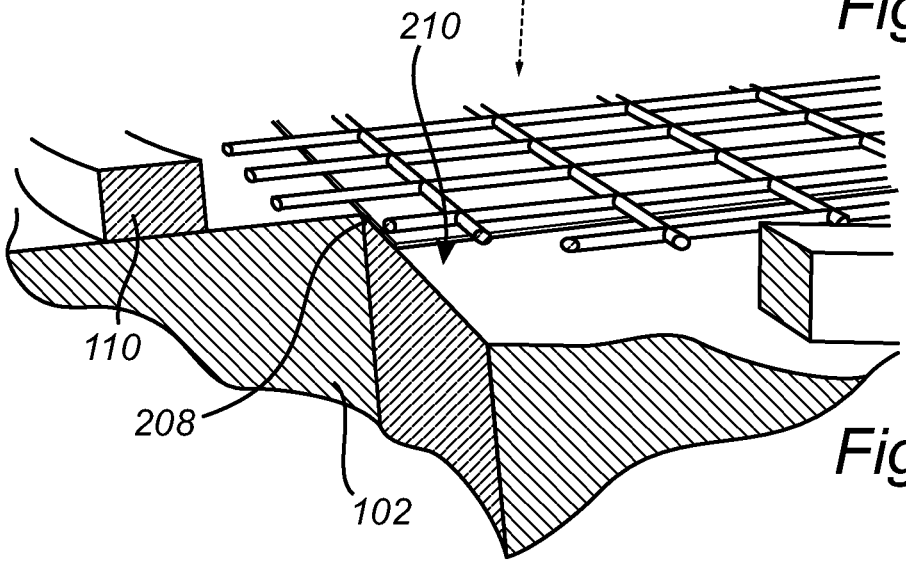

Turning now to FIGS. 2A-2C, where it is conceptually illustrated an embodiment of the present disclosure. In FIG. 2A, the field emission light source 200 is exemplified to have an essentially circular shape and is shown as a lighting chip. It should however be understood that in line with the above discussion the field emission light source 200 may be differently shaped, e.g. to be elliptical or rectangular. Also the field emission light source 200 may be arranged to emit light e.g. within the visible and/or UV light spectrum.

In comparison to the prior-art solution as shown in FIG. 1, the field emission light source 200 as shown in FIG. 2 additionally comprises an at least partly permeable structure. The permeable structure is in FIG. 2 exemplified as a wire mesh 202, comprising a plurality of wires 204 and 206 arranged to form a rectangular spaced structure. In a possible embodiment of the present disclosure a diameter of the wires 204, 206 is selected to be between 20 um and 200 um. A distance between the wires may additionally be selected such that open area portion for the wire mesh 202 is between 40% and 90%, thereby allowing rest gas molecules to pass through the wire mesh 202.

In accordance to the present disclosure, the wire mesh 202 is provided with a plurality of nanostructures 104 as discussed above. The wire mesh 202 will thus form at least partly protruding structures for the nanostructures 104, providing the first electrical field amplifying effect as discussed above. A detailed view of the nanostructures 104 arranged at the wire mesh 202 is provided in FIG. 2B.

The field emission light source 200 also comprises a getter element 208. However in line with the concept of the present disclosure, the getter element 208 is arranged beneath the wire mesh 202, as detailed in FIG. 2C, between a surface of a top side 210 the substrate 102 and the wire mesh 202. Accordingly, the getter element 208 will be sandwiched between the substrate 102 and the wire mesh 202.

The getter element 208 is preferably arranged at the same electrical potential as the wire mesh 202, resulting in that the getter will preferably accept positively charged ions, that would to larger extent otherwise risk adsorption on the cathode tips and thus risk quenching the cathode current.

Figure 3A:
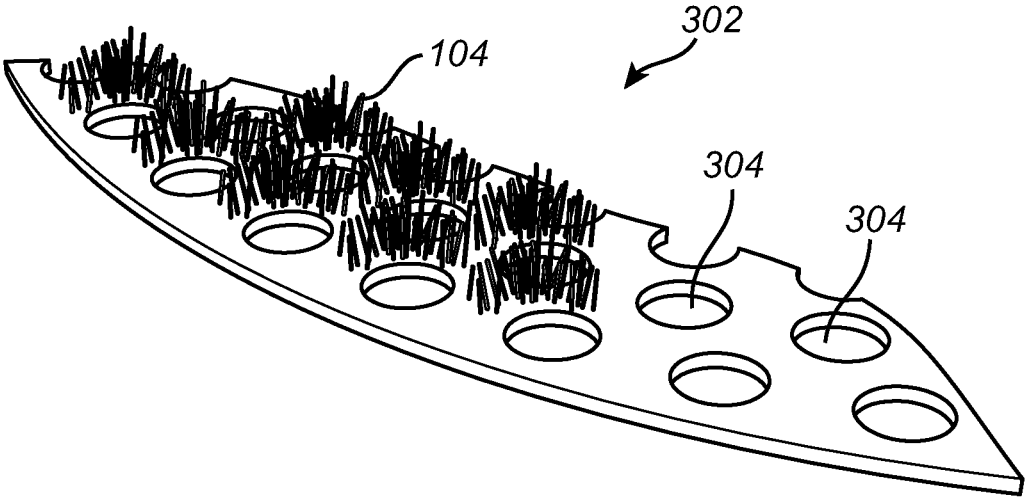
FIGS. 3A and 3B show alternative embodiments of the present disclosure.

In FIG. 3A there is shown a slightly different possible implementation of the present disclosure, as compared to the illustration shown in FIGS. 2A-2C. Specifically, the at least partly permeable structure is formed from an electrically conductive sheet material 302, provided with a plurality of via holes 304. The number of via holes 304 and a diameter of the via holes 304 may be controlled for achieving a desirable permeability of the electrically conductive sheet material 302, such as e.g. between 40%-90%. The first field amplification will occur on the edges of the openings.

Figure 3B:
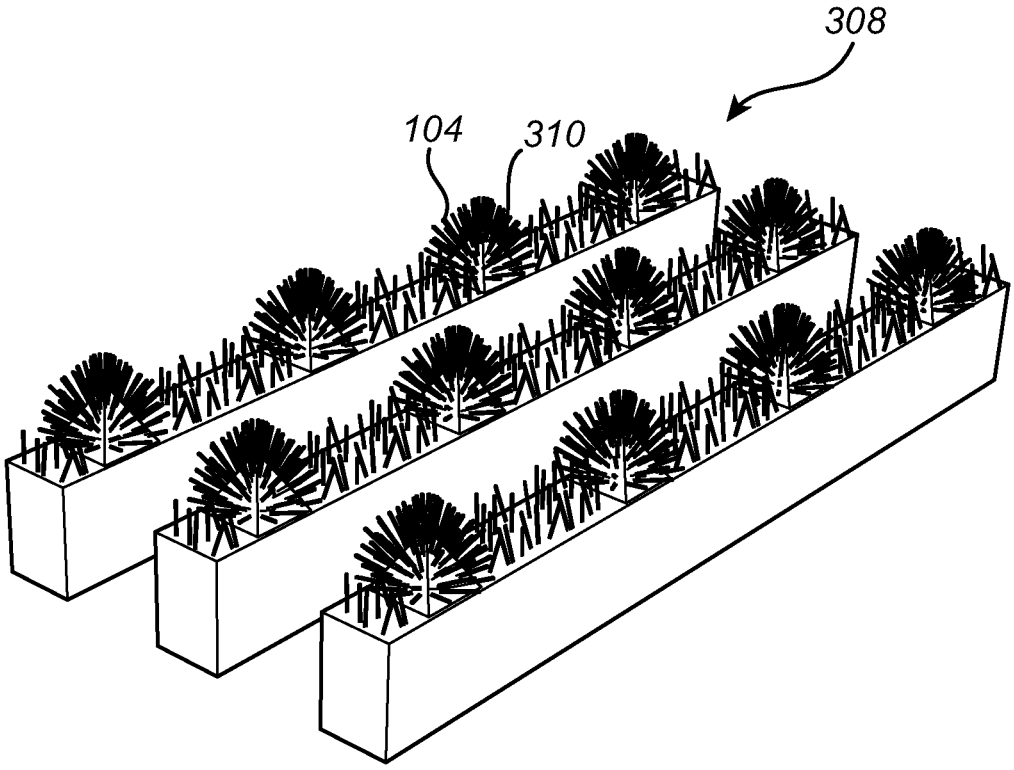

In a corresponding manner, the illustration provided in FIG. 3B shows a further different possible implementation in accordance to the present disclosure, as compared to the illustration shown in FIGS. 2A-2C. Specifically, the at least partly permeable structure comprises a plurality of bars 308 arranged essentially in parallel with each other. The bars 308 are exemplified to have a diameter greatly extending the diameter of the wires 204, 206 as shown in FIG. 2. The bars 308 are in in turn provided with protrusions 310 onto which the nanostructures 104 are provided. In a similar manner as discussed above, the bars 308 are preferably arranged to have a distance them between that allows the permeability and thus access to the getter element 210 to be e.g. between 40%-90%.

It should be understood that the wires 204, 206 or the bars 308 not necessarily must be completely straight as illustrated in the drawings. Rather, they may be formed to be curved or slightly waved without departing from the scope according to the present disclosure. Additionally, it may be possible to only use e.g. parallel wires (i.e. not formed as a wire mesh), thus only arranged in one direction such as only including the wires 204 and not the wires 206. Further alternatives for forming the at least partly permeable structure is possible and within the scope of the present disclosure.

In summary, the present disclosure relates to a field emission cathode structure for a field emission arrangement, comprising a substrate having a first and a second side, a getter element arranged on top of the first side of the substrate and covering a portion of the first side of the substrate, an at least partly permeable structure arranged on top of at least a portion of the getter element, and an electron emission source arranged to cover a portion of the at least partly permeable structure.

In accordance to the present disclosure there is provide a possibility to position the getter element underneath an at least partly permeable structure comprised with the field emission cathode, whereby the rest gas molecules as discussed above are allowed to "pass through" the at least partly permeable structure comprised with the field emission cathode.

Although the figures may show a specific order of method steps, the order of the steps may differ from what is depicted. In addition, two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps. Additionally, even though the present disclosure has been described with reference to specific exemplifying embodiments thereof, many different alterations, modifications and the like will become apparent for those skilled in the art.

Variations to the disclosed embodiments can be understood and effected by the skilled addressee in practicing the claimed present disclosure, from a study of the drawings, the disclosure, and the appended claims. Furthermore, in the claims, the word "comprising" does not exclude other elements or steps, and the indefinite article "a" or "an" does not exclude a plurality.

The invention claimed is:

1. A field emission cathode structure for a field emission arrangement, comprising:

a substrate having a first and a second side;

a getter element arranged on top of the first side of the substrate and covering a portion of the first side of the substrate;

an at least partly permeable structure arranged on top of at least a portion of the getter element; and an electron emission source arranged to cover a portion of the at least partly permeable structure, wherein the getter element is sandwiched between the substrate and the at least partly permeable structure.

2. The field emission cathode structure according to claim 1, wherein the electron emission source comprises a plurality of nanostructures.

3. The field emission cathode structure according to claim 2, wherein the plurality of nanostructures comprises at least one of ZnO nanostructures and carbon nanotubes.

4. The field emission cathode structure according to claim 3, wherein the plurality of ZnO nanostructures is adapted to have a length of at least 1 um.

5. The field emission cathode structure according to claim 1, wherein the at least partly permeable structure encapsulates the getter element.

6. The field emission cathode structure according to claim 1, wherein the getter element is formed by arranging a layer of a getter material onto the portion of the substrate.

7. The field emission cathode structure according to claim 6, wherein the getter material is non-evaporable getter material.

8. The field emission cathode structure according to claim 6, wherein the getter material comprises at least one of tantalum (Ta), zirconium (Zr), titanium (Ti), hafnium (Hf), and/or their alloys.

9. The field emission cathode structure according to claim 6, wherein a thickness of the layer of getter material is about 20-100 μm.

10. The field emission cathode structure according to claim 1, wherein the substrate is planar.

11. The field emission cathode structure according to claim 10, wherein the substrate is a wafer.

12. The field emission cathode structure according to claim 11, wherein the wafer is a silicon wafer.

13. The field emission cathode structure according to claim 1, wherein the getter element and the electron emission source are electrically connected.

14. The field emission cathode structure according to claim 1, wherein the at least partly permeable structure is gas permeable.

15. The field emission cathode structure according to claim 1, wherein the at least partly permeable structure is formed from a grid structure.

16. The field emission cathode structure according to claim 15, wherein the grid structure is net shaped and the plurality of nanostructures are arrange onto bars comprised with the net shaped grid structure.

17. A field emission lighting arrangement, comprising:

an evacuated chamber;

a field emission cathode structure according to claim 1, the field emission cathode arranged within the evacuated chamber;

an anode structure arranged within the evacuated chamber; and a light emission member provided with an electron-excitable light emitting material, the light emission member arranged within the evacuated chamber, wherein the getter element is adapted to be activated prior to operation of the field emission lighting arrangement.

18. The field emission lighting arrangement according to claim 17, wherein a voltage level applied between the field emission cathode and the anode structure is selected to be between 5-15 kV.

19. The field emission lighting arrangement according to claim 17, wherein the field emission lighting arrangement is formed as a lighting chip.

20. A field emission lighting system comprising a plurality of field emission lighting arrangements according to claim 17.

* * * * *